US005145535A

United States Patent [19]

Patrick

[11] Patent Number: 5,145,535

[45] Date of Patent: Sep. 8, 1992

[54] METHOD FOR INTERMOLECULAR EXPLOSIVE WITH VISCOSITY MODIFIER

[75] Inventor: Michael A. Patrick, Shalimar, Fla.

[73] Assignee: United States of America as represented by the Secretary of the Air Force, Washington, D.C.

[21] Appl. No.: 660,307

[22] Filed: Feb. 25, 1991

[51] Int. Cl.[5] ..... D03D 23/00

[52] U.S. Cl. ..... 149/109.6; 149/43; 149/45; 149/46; 149/61; 149/75; 149/76; 149/77; 149/83; 149/85; 149/88; 149/92; 264/3.1; 264/3.4

[58] Field of Search ..... 149/109.6, 43, 45, 46, 149/61, 75, 76, 77, 83, 85, 88, 92; 264/3.1, 3.4

[56] References Cited

U.S. PATENT DOCUMENTS

| | | | |
|---|---|---|---|
| 3,861,138 | 1/1975 | Bridgeforth et al. | 60/217 |
| 3,956,038 | 5/1976 | Duguet et al. | 149/4 |
| 4,063,975 | 12/1977 | Fossan et al. | 149/92 |
| 4,221,616 | 9/1980 | McLean | 149/2 |
| 4,331,490 | 5/1982 | Palgrave et al. | 149/46 |
| 4,718,954 | 1/1988 | Machacer et al. | 149/46 |
| 4,764,316 | 8/1988 | Brown et al. | 264/3.1 |
| 4,948,438 | 8/1990 | Patrick et al. | 149/38 |

*Primary Examiner*—Stephen J. Lechert, Jr.
*Attorney, Agent, or Firm*—Charles E. Bricker; Donald J. Singer

[57] ABSTRACT

A method for improving the disperion of particulate materials in intermolecular explosive compositions which comprises dry blending at least one fuel compound and at least one oxidizer compound, a viscosity modifier and a dispersable particulate material, melt blending the resulting dry blend, and thereafter casting the melt into a suitable form, casing or mold. The viscosity modifier suitable for use in the invention is a cationic salt of carboxymethylcellulose ether. The viscosity modifier is added in an amount sufficient to achieve a desired melt viscosity.

10 Claims, No Drawings

METHOD FOR INTERMOLECULAR EXPLOSIVE WITH VISCOSITY MODIFIER

RIGHTS OF THE GOVERNMENT

The invention described herein may be manufactured and used by or for the Government of the United States for all governmental purposes without the payment of any royalty.

BACKGROUND OF THE INVENTION

This invention relates to explosives, particularly to explosive compositions based upon ammonium nitrate.

Traditional general-purpose explosives comprise trinitrotoluene (TNT), which has several disadvantages. It is a Class-A explosive, requiring special mixing and handling procedures and storage facilities, all accordingly increasing the cost of use. The preparation of this explosive is through nitrate substitution of toluene by a mixed acid consisting of concentrated nitric acid and sulphuric acid. The cost of concentrated nitric acid is moderately expensive and any excess nitric acid in the product destabilizes the explosive and presents corrosion problems. Trinitrotoluene is not water soluble and bomb disposal cannot be done economically by steam or hot water.

Intermolecular explosives are melt castable energetic materials comprising separate fuel and oxidizer components, often as eutectic mixtures. It is known to produce cast high explosive compositions by solidification of a molten mixture of ammonium nitrate (AN) and ethylenediamine dinitrate (EDDN). A binary mixture of ethylenediamine dinitrate and ammonium nitrate is water soluble, thereby having several advantages over trinitrotoluene such as safer storage as a non-explosive water solution and cheaper disposal. However, the binary mixture has a high melting point, has stability problems, and is expensive.

Ammonium nitrate is a hazardous material to manufacture on an industrial scale, to handle in large amounts, and to store in great masses, especially for relatively long periods of time. The shock sensitivity of ammonium nitrate increases seriously after exposure to a few temperature cycles through the 32.3° C. (90° F.) transition point of AN. (UP to 32.3° C. the stable crystal form is orthorhombic bipyrimidal; from 32.3° C. to 84° C. the stable crystal form is orthorhombic).

It is known to add potassium nitrate (KN) to an AN-/EDDN mixture to improve its stability. The problems associated with the binary mixture remain and the amount of chloride impurities is increased by the additional chloride impurities found in potassium nitrate (KN). If these impurities are not removed, the explosive has serious corrosion problems. If the impurities are removed the cost of the explosive increases greatly.

Other explosives compositions based upon ammonium nitrate include AN/TNT/RDX (cyclotrimethylenetrinitramine), AN/MeNQ (methyl nitroguanidine), AN/EDDN/KN/Al, AN/EDDN/KN/NQ (nitroguanidine) and the like.

Many intermolecular explosives require the addition of particulate materials, such as monomolecular explosives, aluminum, or the like, to increase performance, to adjust sensitivity, or to tailor properties for specific applications. Melt castable explosives generally have extremely low viscosities while in the melt state. Accordingly, loading such explosives with particulate materials requires the addition of thickening agents such as silicates to prevent settling of the particulates during the casting and subsequent steps. Loading techniques used heretofore are either inadequate to keep the particulates in suspension or result in lowered explosive performance.

Accordingly, it is an object of this invention to provide a method for improving the dispersion of particulate materials in intermolecular explosive compositions.

Other objects and advantages of the present invention will be apparent to those skilled in the art from a reading of the following description of the invention.

SUMMARY OF THE INVENTION

In accordance with the present invention there is provided a method for improving the dispersion of a particulate materials in intermolecular explosive compositions which comprises dry blending at least one fuel compound and at least one oxidizer compound, a viscosity modifier and a dispersable particulate material, melt blending the resulting dry blend, and thereafter casting the melt into a suitable form, casing or mold. The viscosity modifier is added in an amount sufficient to achieve a desired melt viscosity.

The oxidizing compounds suitable for use in the invention include the nitrate, chlorate and perchlorate salts of lithium, sodium, potassium, magnesium, calcium, strontium, barium, copper, zinc, manganese and lead, as well as ammonium nitrate, ammonium chlorate and ammonium perchlorate, including mixtures thereof. The fuel compounds suitable for use in the invention include the nitrate or perchlorate adducts of ethanolamine, ethylenediamine and higher homologs; aliphatic amides such as formamide, acetamide and urea; urea nitrate and urea perchlorate; nitroguanidine, guanidine nitrate and perchlorate, and triaminoguanidine nitrate and perchlorate; polyols such as ethylene glycol, glycerol and higher homologs; ammonium and metal salts of carboxylic acids such as formic, acetic and higher acids; sulfur-containing compounds such as dimethylsulfoxide; and mixtures thereof.

The viscosity modifier suitable for use in the invention is a cationic salt of carboxymethylcellulose ether. Typically, the sodium slat is used but other salts such as potassium may be used as well. The quantity of viscosity modifier added to the melt is sufficient to achieve a desired melt viscosity, i.e., sufficient to maintain the particulate material in suspension, generally about 0.1 to 3.0 wt %.

The particulate material comprises at least one other fuel-rich or oxidizer-rich component, such as, for example, nitroguanidine, RDX, HMX (cyclo-1,3,5,7-tetramethylene-2,4,6,8-tetranitramine), ammonium perchlorate, aluminum powder, or the like.

If particulate agglomeration occurs, small quantities of surfactants or dispersing agents can be employed without adversely affecting the action of the viscosity modifier.

The following examples illustrate the invention:

EXAMPLE

The following compositions were prepared:

| Ingredient | Parts (wt) |
|---|---|
| Composition 1 | |
| Ethylenediamine Dinitrate | 35.88 |
| Ammonium Nitrate | 35.88 |
| Potassium Nitrate | 6.24 |

-continued

| Ingredient | Parts (wt) |
|---|---|
| Aluminum Powder (Alcoa 1401) | 20.00 |
| Carboxymethylcellulose ether, Na salt* | 2.00 |
| Composition 2 | |
| Methylnitroguanidine | 35.10 |
| Ammonium Nitrate | 30.58 |
| Sodium Nitrate | 3.51 |
| Nitroguanidine | 8.81 |
| Aluminum Powder (Alcoa 1401) | 20.00 |
| Carboxymethylcellulose ether, Na salt | 2.00 |

*Available from EM Science, Cherry Hill, NJ

Both of the compositions were dry blended, melted, with mixing at 105°-110° C., evacuated for 15 minutes at 15 inches Hg, and cast into test items at 95°-100° C.

It is important that the viscosity modifier is dispersed within the explosives ingredients prior to .melting. Adding the viscosity modifier directly to a melt of explosives ingredients results in extensive clumping, incomplete solubilization and extended kettle residence.

No incompatibility has been observed between the viscosity modifier and the ammonium nitrate-based intermolecular sives tested. Normal processing temperatures, i.e., about 80°-110° C., can be used with negligible decomposition of the viscosity modifier. The viscosity modifier can be considered as additional fuel and the formulation can be optimized with respect to oxygen balance.

Various modifications may be made to the invention as described without departing from the spirit of the invention or the scope of the appended claims.

I claim:

1. A method for improving the dispersion of particulate materials in intermolecular explosive compositions which comprises dry blending at least one fuel compound and at least one oxidizer compound, a viscosity modifier and a dispersible particulate material, melt blending the resulting dry blend, and thereafter casting the melt, wherein said dispersible particulate material is at least one other fuel or oxidizer-rich component different from said fuel compound and said oxidizer compound.

2. The method of claim 1 wherein said viscosity modifier is added in an amount sufficient to achieve a desired melt viscosity.

3. The method of claim 1 wherein said oxidizer compound is selected from the group consisting of the nitrate, chlorate and perchlorate salts of lithium, sodium, potassium, magnesium, calcium, strontium, barium, copper, zinc, manganese and lead, and ammonium nitrate, ammonium chlorate and ammonium perchlorate.

4. The method of claim 1 wherein said fuel compound is selected from the group consisting of the nitrate and perchlorate adducts of ethanolamine, ethylenediamine and higher homologs, aliphatic amides, urea nitrate, urea perchlorate, nitroguanidine, guanidine nitrate and perchlorate, triaminoguanidine nitrate and perchlorate, polyols, ammonium and metal salts of carboxylic acids, and sulfur-containing compounds.

5. The method of claim 1 wherein said viscosity modifier is a cationic salt of carboxymethylcellulose ether.

6. The method of claim 5 wherein the quantity of viscosity modifier added to the melt is about 0.1 to 3 0 wt %.

7. The method of claim 1 wherein said particulate material comprises at least one other fuel-rich or oxidizer-rich component.

8. The method of claim 1 wherein said particulate material is aluminum powder.

9. The method of claim 1 wherein said composition consists of ethylenediamine dinitrate, ammonium nitrate, potassium nitrate, aluminum powder and sodium salt of carboxymethylcelulose ether.

10. The method of claim 1 wherein said composition consists of methylnitroguanidine, ammonium n , sodium nitrate, aluminum powder and sodium salt of carboxymethylcellulose ether.

* * * * *

UNITED STATES PATENT AND TRADEMARK OFFICE

CERTIFICATE OF CORRECTION

PATENT NO. : 5,145,535

DATED : September 8, 1992

INVENTOR(S) : Michael A. Patrick

It is certified that error appears in the above-identified patent and that said Letters Patent is hereby corrected as shown below:

ON THE TITLE PAGE:

Abstract, line 1, correct the spelling of "dispersion".

Column 1, line 45, "change "UP" to --Up--.

Column 2, line 15, after "dispersison of", delete "a".

Column 3, line 23, "sives" should read --explosives--.

Claim 9, line 4, correct the spelling of "carboxymethylcellulose".

Claim 10, line 2, after "ammonium" change "n" to --nitrate--.

Signed and Sealed this

Twenty-first Day of September, 1993

Bruce Lehman

*Attest:*

BRUCE LEHMAN

*Attesting Officer*

*Commissioner of Patents and Trademarks*